US005087140A

United States Patent [19]

Keeton et al.

[11] Patent Number: 5,087,140

[45] Date of Patent: Feb. 11, 1992

[54] FESTOONING MACHINE FOR CLOTH STRIPS

[76] Inventors: J. Herbert Keeton; David A. Keeton, both of 747 Meader St., Campbellsville, Ky. 42718

[21] Appl. No.: 450,537

[22] Filed: Dec. 14, 1989

[51] Int. Cl.[5] ..... B31B 1/54

[52] U.S. Cl. ..... 493/23; 493/413; 493/411

[58] Field of Search ..... 493/8, 9, 23, 411–415; 270/31, 39, 40

[56] References Cited

U.S. PATENT DOCUMENTS 3,222,997 12/1965 Blatt ..... 91/407
4,499,707 2/1985 Desjobert ..... 493/414
4,869,460 9/1989 Kocsanyi ..... 91/407

*Primary Examiner*—Bruce M. Kisliuk
*Assistant Examiner*—Jack Lavinder
*Attorney, Agent, or Firm*—Nixon & Vanderhye

[57] ABSTRACT

Web material, such as slit, tubular knit cloth from a dye batch used for binding in garment construction, is festooned instead of rolled so that the binding can be used in a completely relaxed condition. The web is caused to move back and forth in a festooning action in a first horizontal dimension, and to be deposited on a platform by a spreader mounted on a frame. The spreader is oscillated to effect festooning by a completely pneumatic drive. The pneumatic drive is an automatic, variable speed pneumatic drive, automatically adjustable to the speed of the cloth. The exhaust from both faces of a piston in a pneumatic cylinder are connected to a valve with a number of adjustable orifice exhaust ports in it. An acutator for selectively allowing progressive flow through one or more of the exhaust ports of the valve engages the web and thereby controls the speed of the pneumatic drive so that it is closely related to the speed of the web. An oscillating platform is disposed beneath the spreader and is oscillated in a dimension perpendicular to the dimension of oscillation of the spreader during festooning.

14 Claims, 3 Drawing Sheets

FIG. 4
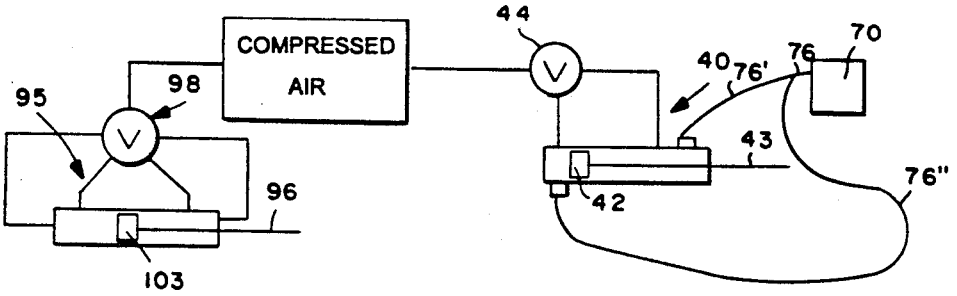
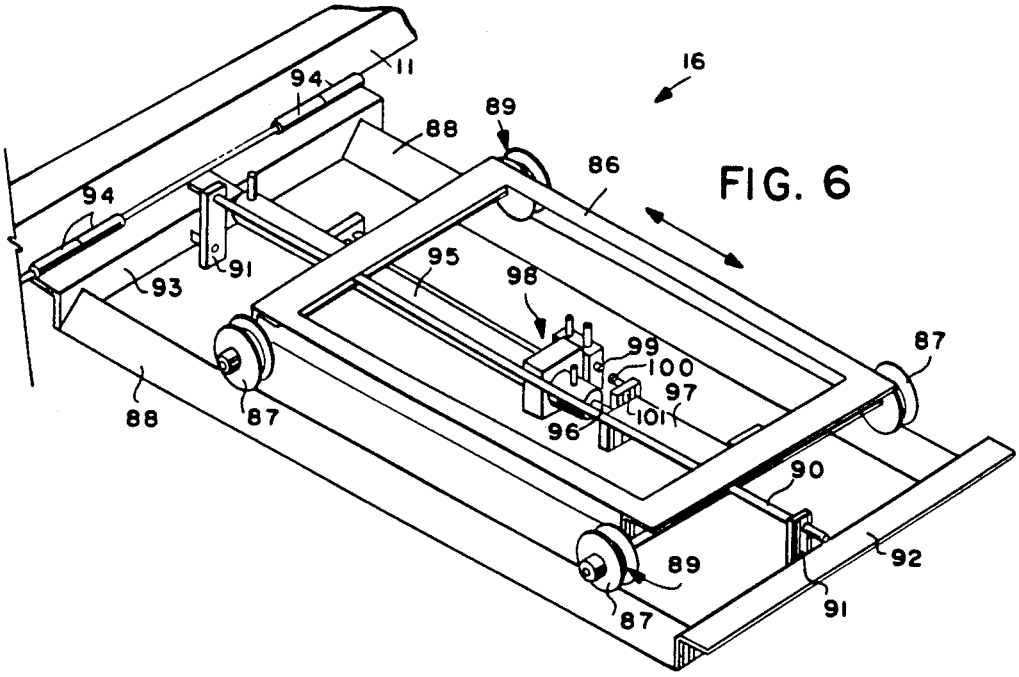
FIG. 6
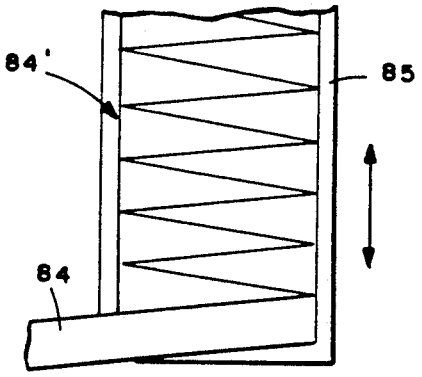
FIG. 7

FESTOONING MACHINE FOR CLOTH STRIPS

BACKGROUND AND SUMMARY OF THE INVENTION

There are many web handling applications where it is desirable to have the web material in a completely relaxed condition after handling. If the web material is taken up on a roll, such a relaxed state cannot be achieved. However, when the web material is festooned (laid down with a back and forth oscillating movement), it is completely relaxed and will not have uneven stretch when utilized.

One particularly useful application of festooned material is in the manufacture of garments, particularly in the use of binding cloth strips, which binding is used at the collar, cuff, or wristband portions of garments being constructed. Typically, tubular knit cloth from a dye batch is passed through a biased slitter to make a strip of web material having a width of about 1 and ½ inches. If this strip of binding material is taken up on a roll, when it is used by the garment maker and taken off of the roll, there will be uneven stretch which is undesirable for a number of processing and quality control reasons. Also, when a roll is utilized, it is necessary to re-thread the equipment after each roll is used, and the material at the end of the roll (each end) is lost.

According to the present invention, it is possible to "take-up" the narrow strips of cloth to be utilized for binding in the construction of garments—and, in fact, any relatively narrow web material—so that such disadvantages are avoided by festooning the web material when it is being taken up, rather than rolling it. This allows a whole batch of dyed cloth to be festooned, and run by the garment maker in one continuous supply. Since the festooned material is completely relaxed, there will be no uneven stretch, and since it is not rolled, no material is lost.

There have been devices for festooning binding cloth strips in the past. For example, the inventors have had in operation such festooning devices that were operated electrically, with a cam effecting the festooning action, and depositing the festooned material onto a stationary platform mounted below a spreader. However, such machines have had far less-than-optimum operation, often laying down material unevenly so that all of the desirable features associated with festooning were not necessarily accomplished and/or the cloth was difficult to handle.

According to the present invention, a method and apparatus has been devised for the festooning of web material which avoids the drawbacks mentioned above. The drawbacks are avoided by utilizing a completely pneumatic variable speed (automatically changing speed in response to web speed) drive for oscillating the spreader during festooning, and/or by slowly oscillating a platform for receiving a web material, just below the spreader, in a dimension generally perpendicular to the dimension of oscillation of the spreader during festooning. These features individually greatly improve the festooning action, and, when combined by the virtually ideal mechanism and method for laying down web material in a completely relaxed, a readily reusable, even configuration of the web.

According to one aspect of the present invention, a festooning machine for web material is provided. The machine comprises the following elements: A frame. Spreader means, mounted on the frame, for engaging the web to guide it during festooning. Means mounted on the frame for directing web material to be festooned to the spreader means; and a fully pneumatic drive means mounted between the frame and the spreader means for effecting movement of the spreader means with respect to the frame so that the web is festooned. The pneumatic drive means preferably comprises an automatic variable speed pneumatic drive, i.e., one that is automatically adjusted in response to the speed of movement of the web of material being festooned. Automatic variable speed pneumatic drives are not conventional, and the particular pneumatic drive according to the invention has been constructed by connecting of the exhaust ports on either side of the piston in a pneumatic cylinder to a special exhaust valve.

The exhaust valve according to the invention includes a valve body with a cylindrically shaped actuator reciprocal within a cylindrically shaped passageway in the valve body. A number of exhaust ports, each with an adjustable orifice (such as provided by adjustment of a needle valve element) operatively communicate with the passageway in the valve body. Reciprocation of the actuator progressively uncovers one or more of the exhaust passages thereby progressively increasing the speed with which the air can exhaust from the cylinder through the ports, and thereby controlling the speed of movement of the piston rod of the pneumatic cylinder. The valve actuator is connected to a rod which engages a loop of the web material, and the rod is moved up and down depending upon the speed of movement of the cloth web.

Preferably, the web engaging rod is disposed in association with a loop of web material between front and rear rollers which are mounted to the frame above the spreader for relative rotation with respect to the frame. These rollers are operatively connected to the pneumatic cylinder so that reciprocation of the piston rod effects unidirectional driving rotation of the rollers. The rollers are also interconnected so that the rear roller (the one furthest from the spreader) is driven at a speed slightly greater (e.g., about 20% greater) than the speed of the front roller. As the speed of the cloth increases or decreases, the tension in the web material between the front and rear rolls will vary, thereby changing the position of the cloth engaging rod, which in turn changes the position of the valve actuator, which in turn controls the rate at which air can be exhausted from the pneumatic cylinder (and, therefore, the speed of reciprocation of the piston rod).

According to another aspect of the present invention, a festooning machine is provided which comprises the following elements: A frame. Spreader means mounted on the frame for engaging the web to guide it during festooning. Means mounted on the web for directing web material to be festooned to the spreader means. Drive means mounted between the frame and spreader means for effecting movement of the spreader means in a first dimension, with respect to the frame, so that the web is festooned. Means for supporting a platform to receive festooned web material adjacent the bottom of the spreader means; and means for oscillating the platform supporting means in a dimension generally perpendicular to the dimension of movement of the spreader means during festooning. A wheeled support preferably comprises a container (e.g., platform) mounting structure, and it is reciprocated by a pneumatic cylinder. Preferably, the drive means—as described above—is completely pneumatic for the festooning action too, to provide optimum results.

The invention also relates to a method of festooning a narrow cloth web while placing it on a platform. The method comprises the steps of:

(a) causing the web to move back and forth in a festooning action in a first horizontal direction, and to be deposited on the platform; and (b) oscillating the platform in a second horizontal dimension generally transverse to said first direction during the practice of (a). Step (b) is practiced so that the platform moves approximately a distance corresponding to the width of the narrow cloth web for each one-half of a festooning action.

It is a primary object of the present invention to effect efficient festooning of web material. This and other objects of the invention will become clear from an inspection of the detailed description of the invention and from the appended claims.

BRIEF DESCRIPTION OF THE DRAWINGS

FIG. 4 is a schematic showing the interconnection between the pneumatic elements of an exemplary machine according to the present invention;

FIG. 6 is a top detail view of the oscillating platform and drive components therefor, according to the invention; and FIG. 7 is a top plan view of a batch of festooned web material produced utilizing the machine according to the present invention.

DETAILED DESCRIPTION OF THE DRAWINGS

Figure 1:
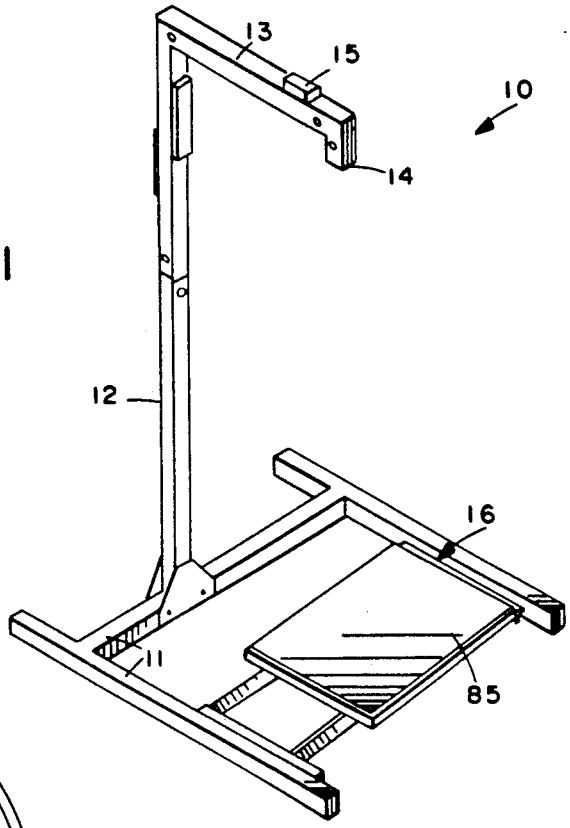
FIG. 1 is a top perspective view of an exemplary frame utilized in the machine according to the present invention with the festooning components removed, but showing an oscillating platform at the bottom thereof.
Figure 3:
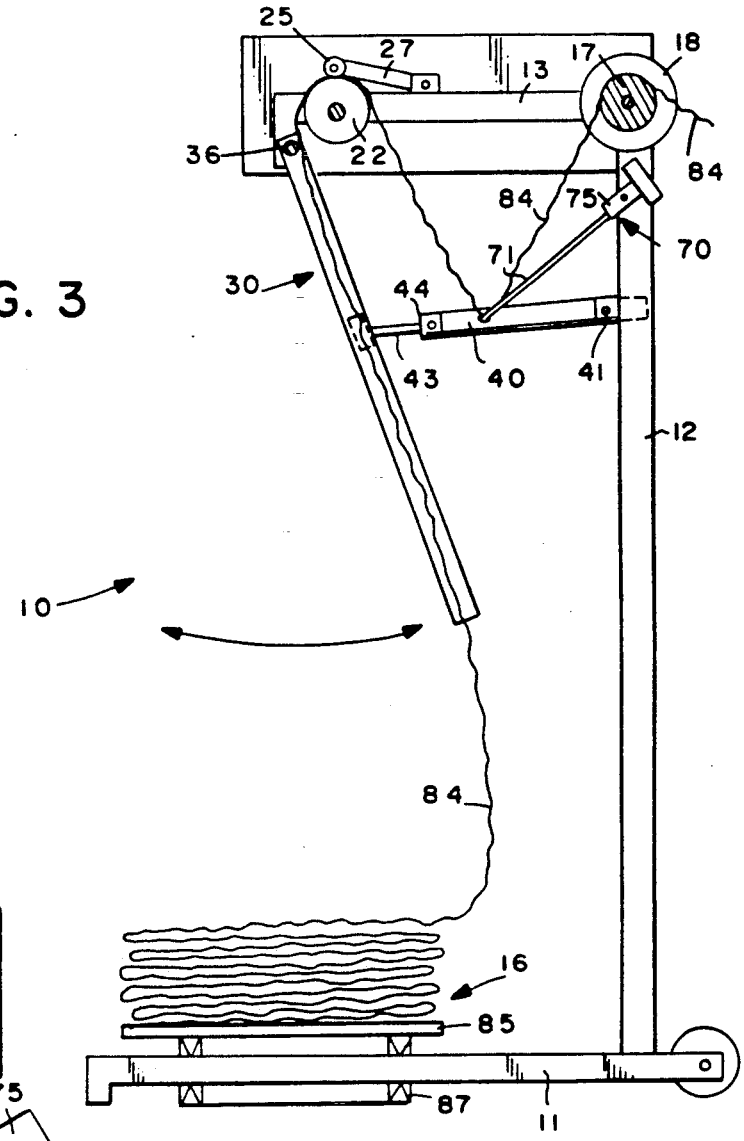
FIG. 3 is a side view of an exemplary machine according to the invention showing it used during festooning.

A festooning machine according to the present invention is shown generally by reference numeral 10 in FIGS. 1 and 3. The basic apparatus includes a frame having bottom portions 11, an upright portion 12, a horizontal top arm 13, and a down-turned end portion 14. Mounted on the arm 13 is a bushing 15. The bottom portions 11 support an oscillating platform structure 16 which is illustrated in detail in FIG. 6.

Means are mounted on the frame 12–14 for engaging a web of material to be festooned for directing the material to be festooned to the festooning structure. The web directing means includes a rear roller 17 having side flanges 18 and mounted for rotation about an axle 19, the axle being received by the frame at the intersection between the portions 12, 13, for relative rotation with respect to the frame. At the opposite side of the arm 13 from the roll 17 is a pulley 20 also connected to the axle 19. In front of the rear roll 17 is a front roll 22 which is mounted for rotation about the axle 23 received by the arm 13 for relative rotation with respect to the frame, and a pulley 24 is provided on the axle 23 on the opposite side of the roll 22 from the frame 13. To hold the web in contact with the front roll 22, an idler roll 25 preferably is provided, mounted for rotation about axle 26. The axle 26 is connected to an arm 27 which is turn is connected to the shaft stub 28 which is received by the bushing 15. Normally just the gravitational force of the idler roll 25 will hold the web of material in contact with the roll 22, but a spring mechanism could also be provided.

The machine 10 also includes a spreader means 30, mounted on the frame 12–14, for engaging the web to guide the web during the actual festooning action. The spreader mechanism 30 is known per se comprising a solid bar 31 along one vertical edge and having plates 32, 33 extending horizontally therefrom which define a channel having an open end 34 opposite the bar 31. The plates 32, 33 are typically about the same width as the web of material to be festooned, and the open end 34 is preferable so as to provide for easy insertion of the web material into the spreader 30. A bushing 35 is provided in the frame portion 14 for receipt of the shaft 36 which is attached to the bar 31 at one end thereof, and at pin 37 to the lever 38 at the other end thereof. The shaft 36 allows for oscillation of the spreader means 30 with respect to the frame 12–14.

The driving mechanism for the spreader means 30, and preferably also for the rolls 17, 22, is most desirably a pneumatic cylinder 40. A pneumatic cylinder has a number of advantages over electric motors for this purpose, and since automatic speed control is provided for the pneumatic cylinder 40 according to the present invention, such a structure is a virtually ideal drive means. According to the present invention it is highly preferably to provide a fully pneumatic drive means mounted between the frame and the spreader means for effecting movement of the spreader means with respect to the frame so that the web is festooned.

Figure 2:
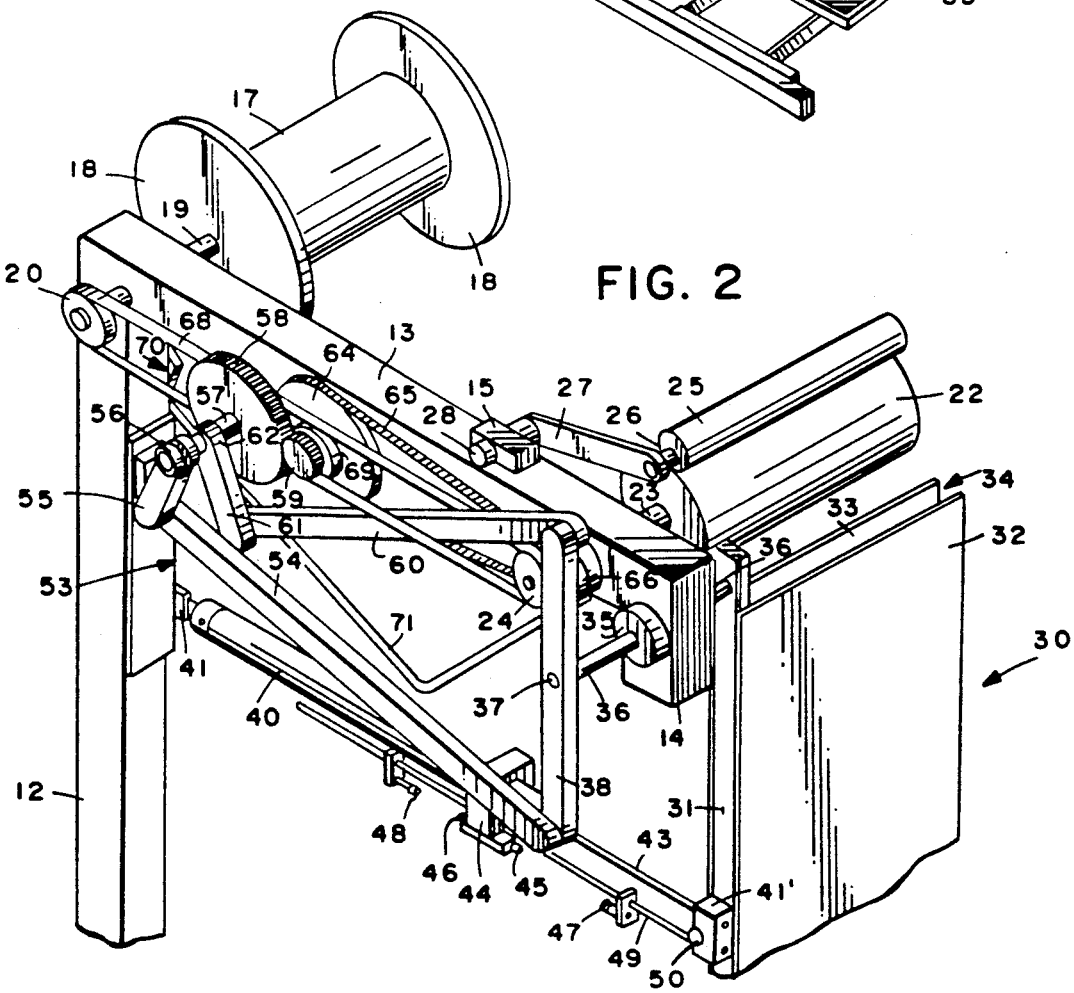
FIG. 2 is a front perspective detail view of the frame of FIG. 1 with the web drive and festooning components attached thereto.

The cylinder 40 is mounted at one end 41 thereof to the frame 12. A piston 42 (see FIG. 4) having a piston rod 43 is provided within the cylinder 40, and the piston rod 43 is connected at the free end thereof to a mounting structure 41' on the bar 31 of the spreader 30. An on-off valve 45 is provided for controlling the supply of compressed air from a compressed air source (see FIG. 4) to one of the other faces of the piston 42. The valve 44 is mounted on the cylinder 40 and therefore remains relatively stationary during the festooning action. The valve 44 is automatically operated by the actuator elements 45, 46 (see FIG. 2) extending from either side thereof, and the spring loaded trip stops 47, 48 which are mounted on the rod 49 which is attached at end 50 thereof to the structure 41'. As the piston rod moves out from, and back into, the cylinder 40, the trip stops 48, 47 will alternately come in contact with the actuator portions 46, 45, switching over the valve 44 to provide end of travel positions, and causing the piston 42 to oscillate back and forth within the cylinder 40.

The pneumatic cylinder 40 preferably effects driving action of the rolls 17, 22 by way of the mechanism 53. The mechanism 53 includes the lever pivotally mounted at one end thereof to the lever 38 and at the opposite end thereof to the lever 55. The lever 55 is connected by one way bearing 56 to the shaft 57, which is journaled in the frame arm 13. A gear 58 is mounted on the shaft 57, and cooperates with smaller gear 59 which is also journaled for rotation in the frame arm 13. At the opposite end of the lever 38, the lever 60 is pivotally connected, and at the lever 60's opposite end it is pivotally connected to the arm 61, which in turn is connected by a one way bearing 62 to the shaft 57.

Mounted for rotation with the gear 59 is a pulley 64 which is connected by belt 65 to a pulley 66 which is mounted on the same shaft 23 as the pulley 24. The belt 68 connects the pulleys 20, 24, with the idler 69 guiding the belt 68. Utilizing the mechanism 53, the oscillation of the shaft 36 is transformed into unidirectional rotation of the rolls 17, 22, and because of the particular pulley and gear arrangement, it is possible to provide a speed differential between the rollers 17 and 22 if desired. Under most circumstances it is desirable to have the rear roll 17 driven at a slightly faster speed than the front roll 22 (e.g. with about a 20% speed differential).

Figure 5:
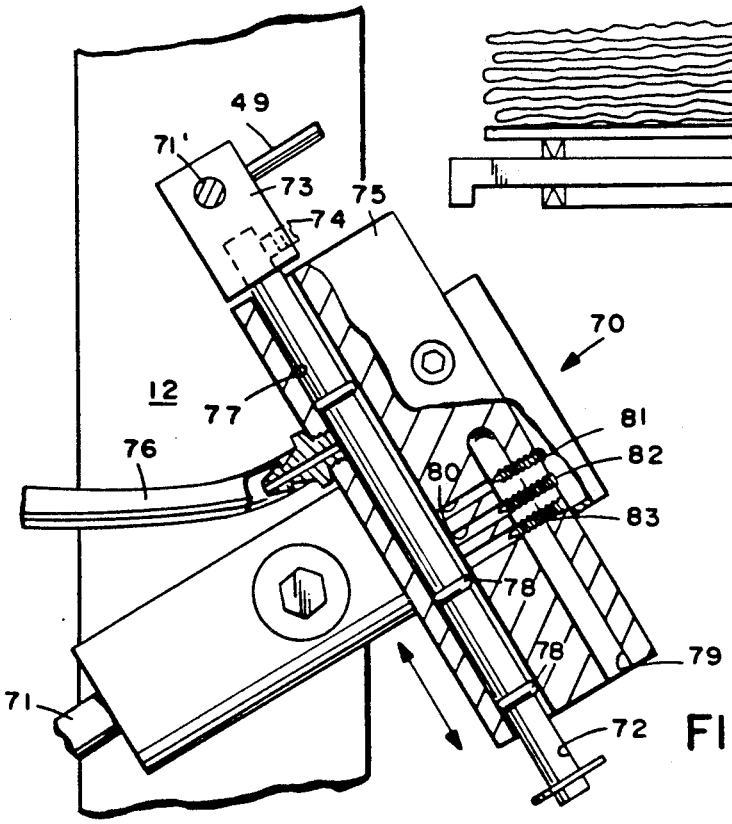
FIG. 5 is a side view, partly in cross section and partly in elevation, of the exhaust valve according to the invention for providing automatic variable speed control of the pneumatic drive cylinder.

Automatic speed control for the pneumatic cylinder 40 is provided by the unique exhaust valve 70 according to the invention, illustrated most clearly in FIGS. 5, 3, and 4, and the web engaging rod 71 operatively connected thereto. Rod 71 is pivotally mounted to the frame portion 12 for oscillation about a horizontal axis generally parallel to the plane of the web, and connected by a conventional linkage (not shown) including the portion 71' to the valve actuator element 72 to effect reciprocation of the element 72 and thereby control the amount of exhaust flow that is allowed from the cylinder 40. A cap 73 is connected at the drive end of the valve actuator 72 by an adjustment screw 74, and the actuator is mounted for reciprocation within the valve body 75. A conduit 76 supplies exhaust air to the valve body 75 from the exhaust tubes 76', 76'' which are disposed on opposite ends of the piston 42 of the cylinder 40 (see FIG. 4). A passageway 77 is formed in the valve body 75 for receipt of the actuator 72, both the passageway 77 and the actuator 72 preferably being cylindrical (and preferably having a circular cross-section). O-rings 78, or like sealing means, are mounted on the actuator 72 to provide a sealing engagement between the actuator 72 and the valve passage 77. An outlet 79 is provided from the valve housing 75 on the opposite side of the passageway 77 from the conduit 76.

A plurality of exhaust ports 80 are provided in the valve body 75 between the inlet 76 and outlet 79. The exhaust ports 80 are parallel to each other and valve elements 81, 82, 83 are provided in association with the exhaust ports 80 so that each is an adjustable orifice. As illustrated in FIG. 5 the elements 81–83 preferably comprise screws (needle valves). The screws 81–83 are adjusted so that any desired flow of exhaust gas from each of the ports 80 is provided. The provision of the plurality of exhaust ports, in combination with the reciprocation of the valve element 72 which selectively covers all of the exhaust ports 80 (in an off position) or uncovers one or more of the exhaust ports 80 depending upon the speed of the web, controls the allowable exhaust rate of the gas from the cylinder 40 of course controlling the speed of oscillation of the piston 42 and thereby matching the festooning action and roll driving speed to the web speed.

FIG. 3 illustrates the manner in which the rod 71 contacts the web 84, which may be a web of slit tubular knit dyed cloth binding having a width of about one and one-half inches (although many other webs could also be utilized). The lowermost portion of the rod 71 (see FIG. 2) rests on the loop of the web 84 between the rolls 17, 22. The speed of the fabric 84 will cause the loop to move up and down, and the rod 71 (which also could be a dancer roller) is responsive to this up and down movement of the loop of web 84, and thus the speed of travel of the web.

The platform mechanism 16 preferably comprises a removable platform 85 that is mounted on a wheeled carriage 86 (see FIG. 6), for receipt of the festooned web material 84, as illustrated in FIG. 3. While a naked platform 85 is illustrated in FIGS. 1 and 3, it is to be understood that the platform may comprise the bottom of a box-like container, or the like, or any other structure that conveniently receives the festooned web 84.

As most clearly illustrated in FIG. 6, the carriage 86 has wheels 87 which move on V-shaped tracks 88, V-grooves 89 in the wheels 87 engaging the tracks 88 for guided movement therealong. Guide rod 90 connected at the ends 91 thereof to the frame portion 11, and the angle 92 at the end of the tracks 88, passes through holes (not shown) in the carriage 86 and also assists in guiding the carriage 86 during its reciprocation. At the end of the tracks 88 the angle irons 92, 93 are provided. The angle iron 92 may be a free angle iron, while the angle iron 93 may be mounted by conventional piano hinges 94 to the frame bottom portion 11 so that the entire track and wheeled carriage can be pivoted upwardly if desired (as during movement of the frame).

Reciprocation of the carriage 86 is provided by the cylinder 95 (FIGS. 4 and 6) which includes a piston rod 96 extending therefrom and connected to the flange 97, which in turn is welded or otherwise attached to the carriage 86. A valve 98 is mounted on the cylinder 95, which at the end thereof opposite the piston rod 96 is connected to the flange 93. The valve 98 has a valve actuator 99 operated by a spring loaded trip pin 100 mounted to flange 101, which in turn is mounted to flange 97, with another trip pin and valve actuator element (not shown) at the opposite side of the valve 98. The operation of the valve 98 is essentially identical to that of the valve 44, reciprocation of the piston rod 96 by the supply of air to either side of the piston 103 in the cylinder 95 effecting movement of the carriage 86 until an end of travel condition is achieved (one-half of a complete oscillation of carriage 86), which then results in the trip pin tripping the valve actuator for the valve 98 and starting the oscillatory movement in the opposite direction.

The valve 98 is a conventional valve such as a Humphrey double acting valve with exhaust flow controls to allow manual adjustment to the right speed. The valve 98 is manually adjusted so that the approximate speed of oscillation of the carriage 86 in a horizontal dimension essentially perpendicular to the dimension of oscillation of the spreader 30 (see FIG. 3) is such that the carriage 86 moves a distance corresponding to the width of the web 84 for each one-half of an oscillation of the spreader 30 (one-half of each festooning action). This results in even lay down of the web 84 as illustrated by reference numeral 84' in FIG. 7, so that the entire web is not built up in a narrow stack, but is evenly laid over the removable platform 85 on the carriage 86. For simplicity, manual controls only for the cylinder 95 are provided since even though the speed of the festooning action will change somewhat depending upon the web speed, it is not necessary for the oscillation speed of the carriage 86 to be exactly such that it moves one width of the narrow cloth web for each half of a festooning oscillation, only a general approximation is necessary.

Operation

The web 84 is fed by any suitable conventional mechanism, depending upon the particular characteristics and treatment of the web 84, to the rear roll 17, loops down under the rod 71 (or dancer roller), up over the front roll 22 underneath the idler roll 25, and into the open ended channel defined by the plates 32, 33 of the spreader 30. Compressed air is alternately supplied to opposite faces of the piston 42 of the pneumatic cylinder 40, causing it to oscillate back and forth. Since the piston 42 is connected by the piston rod 43 to spreader 30, this causes oscillation of the spreader 30 and thereby festooning action of the web 84 onto the removable platform 85 of the oscillating platform means 16.

If the speed at which the web 84 is being fed is slow, the rod 71 will pivot and drive the valve actuator 72 (upwardly and to the left in FIG. 5) so that the central O-ring 78 thereof covers two of the exhaust ports 80, allowing exhaust flow from inlet 76 to outlet 79 only through the first exhaust port, the orifice of which is adjusted by the needle valve 81. Should the speed of the web increase, the rod 71 will effect downward and rightward (as viewed in FIG. 5) movement of the actuator 72 so that the middle O-ring 78 uncovers the second exhaust port 80, the orifice of which is adjusted by the needle valve 82, allowing a larger exhaust flow from the cylinder 40, and thereby increasing the speed of reciprocation of the cylinder 43. If the speed of the web 84 increases even more, the actuator 72 will be moved to the fully open position illustrated in FIG. 5. The needle valves 81 through 83 can be adjusted so that any range of speed and any speed increments desired are provided. In this way the cylinder 43, valve 70, valve 44, and the like provide a fully pneumatic automatic variable speed pneumatic drive.

Oscillation of the piston rod 43, and subsequent oscillation of the spreader 30 about the shaft 36, also causes movement of the levers 54, 60 and—through the one way bearings 56, 62—unidirectional rotation of the shaft 57, and thereby the gear 58. The gear 58 drives the gear 59, which in turn drives pulley 64, which in turn drives pulley 66/24, which in turn drives pulley 20. In this way the front and rear rolls 22, 17 are also driven by the cylinder 40, and the particular gearing and pulley arrangements provided may be dimensioned and positioned so as to provide a speed differential between the drives of the rolls (e.g. driving the rear roll 17 about 20% faster than the front roll 22).

While the festooning action is going on, the cylinder 95 is being operated to slowly oscillate the carriage 86 back and forth, so that all of the festooned cloth 84 does not pile up in the same area, but is spread over the width of the platform 85, as illustrated at 84' in FIG. 7. Once an entire batch of web material 84 has been festooned, the platform 85 is removed from the carriage 86, and the festooned web is transported to where it will be utilized. For example if it is a slit tubular knit cloth that is used for binding purposes for garments, it will be transferred to the garment maker and can then be fed without tension by the garment maker to the sewing machine for stitching the cloth to the garments.

It will thus be seen that according to the present invention a method and apparatus are provided for the effective, simple, festooning of web material. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and procedures.

What is claimed is:

1. A festooning machine for web material comprising:
a frame;
spreader means, mounted on said frame, for engaging the web to guide it during festooning;
means mounted on said frame for directing web material to be festooned to said spreader means; and
an automatic variable speed fully pneumatic drive means mounted between said frame and said spreader means for effecting movement of said spreader means with respect to said frame so that said web is festooned;
said variable speed pneumatic drive comprising a pneumatic cylinder with a piston reciprocal therein, and having first and second faces with a piston rod extending from said first face; means for supplying compressed air to either said first or said second face; means for exhausting air from adjacent the face to which air is not supplied; and means responsive to the speed of movement of said web adjacent said web directing means for controlling the exhaust flow from said exhausting means, and thereby the speed of movement of said piston rod.

2. A machine as recited in claim 1, wherein said means for directing web material comprises a front roll mounted to said frame for rotary movement with respect thereto and disposed adjacent said spreader means, and a rear roll mounted to said frame for rotation with respect thereto.

3. A machine as recited in claim 2, further comprising means for operatively connecting said front and rear rolls to said piston rod so that reciprocation of said piston rod effects unidirectional rotation of said front and rear rollers.

4. A festooning machine for web material comprising:
a frame;
spreader means, mounted on said frame, for engaging the web to guide it during festooning;
means mounted on said frame for directing web material to be festooned to said spreader means, comprising a front roll mounted to said frame for rotary movement with respect thereto and disposed adjacent said spreader means, and a rear roll mounted to said frame for rotation with respect thereto;
a fully pneumatic drive means mounted between said frame and said spreader means for effecting movement of said spreader means with respect to said frame so that said web is festooned, said drive means including a piston rod; and
means for operatively connecting said front and rear rolls to said piston rod so that reciprocation of said piston rod effects unidirectional rotation of said front and rear rollers.

5. A machine as recited in claim 4, wherein said pneumatic drive means comprises an automatic variable speed pneumatic drive.

6. A machine as recited in claim 5, wherein said variable speed pneumatic drive comprises a pneumatic cylinder with a piston reciprocal therein, and having first and second faces with said piston rod extending from said first face; means for supplying compressed air to either said first or said second face; means for exhausting air from adjacent the face to which air is not supplied, and means responsive to the speed of movement of said web adjacent said web directing means for controlling the exhaust flow from said exhausting means, and thereby the speed of movement of said piston rod.

7. A machine as recited in claim 6, wherein said means for supplying compressed air to said piston comprises first valve means for directing a source of compressed air to either said first or second face including a valve actuator operatively mounted on said cylinder and valve actuating means mounted to said spreader means for operatively engaging said actuator during movement of said spreader with respect to said frame.

8. A machine as recited in claim 7, wherein said exhausting means comprises a second valve means, said second valve means having a plurality of exhaust ports therein and adjustable valve elements cooperating with said ports to control the exhaust flow therethrough; and an actuator movable to provide or prevent communication between said cylinder and one or more of said exhaust ports.

9. A machine as recited in claim 8, wherein said actuator comprises a reciprocal element, and wherein said means responsive to the speed of movement of said web comprises a rod operatively connected to said reciprocal actuator, and engaging said web.

10. A machine as recited in claim 6, wherein said means for directing web material comprises a front roll mounted to said frame for rotary movement with respect thereto and disposed adjacent said spreader means, and a rear roll mounted to said frame for rotation with respect thereto; and wherein said means responsive to the speed of movement of said web comprises a web engaging rod between said front and rear rolls.

11. A machine as recited in claim 10, further comprising means for operatively connecting said front and rear rolls to said piston rod so that reciprocation of said piston rod effects unidirectional rotation of said front and rear rollers.

12. A machine as recited in claim 11, wherein said means for operatively connecting said front and rear rollers to said piston rod effects a rotational speed of said rear roll that is slightly higher than that of said front roll.

13. A machine as recited in claim 5, further comprising means for supporting a platform for receipt of festooned web material, said means mounting a platform below said spreader means; and means for oscillating said container receiving means in a dimension generally perpendicular to the dimension of movement of said spreader means.

14. A machine as recited in claim 4, wherein said means for operatively connecting said front and rear rollers to said piston rod effects a rotational speed of said rear roll that is slightly higher than that of said front roll.

* * * * *